United States Patent [19]

Camenisch et al.

[11] 4,191,567

[45] Mar. 4, 1980

[54] PROCEDURE FOR MAKING A REUSABLE PHOTOCONDUCTING CHARGE IMAGE CARRIER AND CHARGE IMAGE CARRIERS PREPARED BY THIS METHOD

[75] Inventors: Hans Camenisch, Chur; Jarmila Bachner, Egg, both of Switzerland

[73] Assignee: Elfotec A.G., Zumikon, Switzerland

[21] Appl. No.: 546,815

[22] Filed: Feb. 3, 1975

[30] Foreign Application Priority Data

Feb. 1, 1974 [DE] Fed. Rep. of Germany ..... 2404919

[51] Int. Cl.[2] ..... G03G 5/04; G03G 5/09; G03G 5/08

[52] U.S. Cl. ..... 430/64; 430/130; 430/131

[58] Field of Search ..... 96/1.5, 1.7, 1.8, 1.5 R

[56] References Cited

U.S. PATENT DOCUMENTS

| | | | |
|---|---|---|---|
| 2,986,467 | 5/1961 | Kostelec et al. | 96/1.8 |
| 2,997,387 | 8/1961 | Tanenbaum | 96/1.8 |
| 3,573,906 | 4/1971 | Goffe | 96/1.8 |
| 3,723,110 | 3/1973 | Goffe | 96/1.5 |
| 3,740,217 | 6/1973 | Gramza et al. | 96/1.8 |

*Primary Examiner*—Thomas J. Herbert, Jr.

*Attorney, Agent, or Firm*—Arnstein, Gluck, Weitzenfeld & Minow

[57] ABSTRACT

Long-life multilayer photoconductive members of the ZnO type are obtained when the successive layers are deposited using solvents, drying temperatures, etc. which do not affect the layers previously deposited. In such fashion, at least 4,000 cycles of use are possible.

12 Claims, 1 Drawing Figure

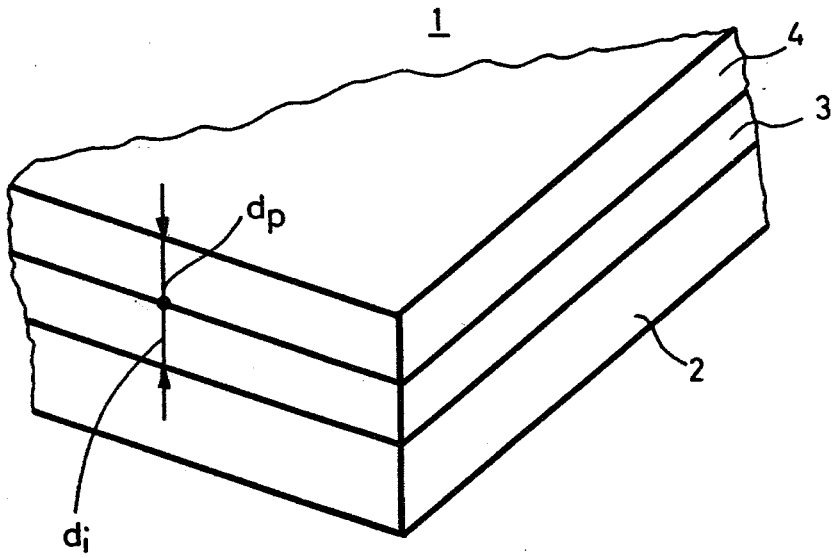
1
4
3
2
$d_p$
$d_i$

PROCEDURE FOR MAKING A REUSABLE PHOTOCONDUCTING CHARGE IMAGE CARRIER AND CHARGE IMAGE CARRIERS PREPARED BY THIS METHOD

Long-life multilayer photoconductive members of the ZnO type are obtained when the successive layers are deposited using solvents, drying temperatures, etc. which do not affect the layers previously deposited. In such fashion, at least 4000 cycles of use are possible.

The invention deals with a method for making a reusable photoconducting charge image carrier and with a reusable charge image carrier as the product of this procedure.

In particular, the invention deals with a photoconducting charge image carrier with zinc oxide as the photoconductor.

Various types of photoconducting layers are known, and employed in practice, in particular in electrostatic reproduction, e.g., selenium films or special papers coated with a photoconducting layer. The photoconducting layer is chiefly ZnO embedded in a binder.

Selenium photoconductors can be electrically charged and discharged many times without causing the photoconductor layer to fatigue or disintegrate rapidly. However, photoconductor layers with ZnO embedded in binders of known compositions can be charged and discharged only about 10–20 times, after which they are no longer usable for electrophotographic reproduction of an image. After a large number of cycles, the resulting fatigue and aging effects in this photoconductor layer make charging in known electrostatic copiers slower, if not too slow. These fatigue and aging effects also mean that not enough charge will be taken up, i.e., the saturation potential will be too small, so that the quality of the image will be inadequate. Moreover, fatigue and aging cause charge to be lost too rapidly in the dark, excessively retard discharge upon illumination, and make the residual voltage too high. Hence, this fatigue and aging makes these charge image carriers unusable in known electrostatic copiers in which the photoconductor is reused repeatedly.

It is true that recently procedures have become known which raise the number of possible reproduction cycles even for ZnO-containing photoconductor layers, but the number of cycles is still limited to about 1000.

ZnO is a much less expensive photoconductor than selenium, which makes it desirable to get a larger number of cycles from a zinc oxide photoconductor, e.g., 4000 or even more.

The objective behind the present invention was therefore to develop a procedure for making a repeatedly reusable photoconducting charge image carrier containing zinc oxide, which would be good for at least 4000 cycles.

The invention deals with a procedure for making a repeatedly reusable photoconducting charge image carrier, characterized in that a first coat containing at least one insulating nonvolatile ingredient is applied to a substrate, in order to produce an insulating layer on the substrate after the coat dries, following which a second coat, containing photoconducting material and at least one binder for it, is applied to this insulating layer, at least one sensitizer for the photoconducting material being mixed into the second coat and the photographic material being dispersed in a solution of at least one binder, the solvent for the second coat being one which will not dissolve the insulating layer, whereupon the substrate, covered by an insulating layer and a second coating, is again dried, and if it was not conducting from the outset, the substrate is made conducting at the latest after the second coat is dried, the resulting charge image carrier finally being conditioned, to obtain a charge image carrier usable for at least about 4000 cycles.

The present invention deals with a charge image carrier prepared by this method, characterized in that there is an insulating layer adhering to an electrically conducting substrate, and above the insulating layer a photoconducting layer, in order to obtain a charge image carrier which can be charged and then discharged by exposure to light at least about 4000 times.

The invention will be illustrated using the accompanying drawing. This diagram shows a part of a charge image carrier in perspective, but not to scale.

The charge image carrier 1 consists of an electrically conducting substrate 2, e.g., a so-called conducting paper, such as those used for the well-known copier papers coated with zinc oxide for electrostatic reproduction. This substrate could also be a metal foil, e.g., aluminum foil. An insulating layer 3 adheres to this substrate 2. To produce this insulating layer 3, a first coat is prepared, containing at least one insulating nonvolatile component, e.g., copolymers such as acrylates, polyvinylidene chloride, polyimides, or polyamides. The solvent or dispersing agent can be a well-known solvent such as toluene, alcohols, or ketones.

The insulating layer 3 produced by means of well-known techniques of application is best dried with infrared radiation, i.e., the solvent or dispersing agent in the layer, e.g., toluene is evaporated.

Next, to produce a photoconducting layer 4, a second coat is applied to the insulating layer 3, which has been dried, e.g., with infrared radiation. Customary coatings for photoconducting layers contain e.g. zinc oxide, dispersed in a binder consisting of a resin or resin mixture dissolved in a solvent containing toluene.

In this invention, the solvent used for the second coat is one which will not attack or dissolve the insulating layer 3. If, for instance, the insulating layer 3 is produced from a toluene dispersion or solution of resin ingredients, the second coating may be an aqueous dispersion of the photoconducting material and a binder. After this second coat is applied in a thin layer to the previously produced insulating layer 3, a second drying is carried out. This drying should involve only moderately high temperature (e.g., about 80° C.) at the surface of the upper layer. This upper bound on temperature is necessary to prevent the photoconducting layer 4 from sinking into the insulating layer 3. This would cause an unacceptable drop in the saturation potential of the finished charge image carrier 1.

If, on the other hand, the drying temperature is too low, e.g., less than about 50° C., the water may remain behind in the resulting photoconducting layer 4, which would impair the electrophotographic sensitivity of the charge image carrier 1.

Because of this structure, the properties of this charge image carrier 1 can be optimized by varying the thicknesses of the layers and by selecting the appropriate chemical and physical properties for the individual layers themselves. It should be kept in mind that the nature of the boundary layer between the insulating layer 3 and the photoconducting layer 4 plays an important role in determining the properties of the finished charge image carrier. Adsorption of gases or vapors will have a crucial influence on the behavior of the charge image carrier 1. Therefore, in preparing the charge image carrier, a clean or precisely defined atmosphere must be provided.

In place of the resin mixture mentioned earlier, copolymers produced from monomers with different properties can be used as material for the insulating layer. One suitable copolymer consists of butyl acrylate and methyl acrylate.

Because the responsibilities are divided between the insulating layer 3 and the photoconducting layer 4, the result is a high saturation potential and good discharge properties, i.e., good image contrast and good photographic density. The insulating layer 3 ensures that the saturation potential is sufficiently high, and the photoconducting layer 4 provides the good discharge or small residual voltage.

We will now give a few examples for the preparation of charge image carriers in accordance with this invention.

The substrate 2 can be any conducting layer, e.g., a metal foil, a "NESA" glass, or a conducting paper such as that used to produce electrophotographic copier paper.

Suitable layer thicknesses $d_i$ and $d_p$:

Insulating layer 3: $d_i \approx 1\text{–}30\ \mu m$.

Photoconducting layer 4: $d_p \approx 1\text{–}50\ \mu m$.

where the symbol "$\mu$m" indicates microns—that is, millionths of a meter.

EXAMPLE 1

The first coat is applied to the substrate 2 and dried, yielding the insulating layer 3. The first coat is polyvinylidene chloride copolymer dissolved in methyl ethyl ketone. The second coat is applied to the insulating layer 3 and dried, yielding the photoconducting layer 4. The second coating is a photographic pigment dispersed in an aqueous solution of the resin or resins. Suitable resins are e.g. vinyl-ester resins, acrylates, styrene acrylates, and combinations of such resins.

EXAMPLE 2

The first coat, applied to the substrate and dried, yields the insulating layer 3. The first coat is polyvinylidene chloride copolymer dissolved in methyl ethyl ketone. The second coat is applied to the insulating layer and dried. The second coat is photographic pigment dispersed in a toluene solution of the resin or resins. Suitable resins are e.g. acrylates, methacrylates, styrene acrylates, and vinyl-ester resins.

EXAMPLE 3

The first coat, applied to the substrate 2 and cross-linked by heating to about 200° C., yields the insulating layer 3. The first coat is methyl methacrylate copolymer with various functional groups, dissolved in toluene. The photoconducting layer 4 is obtained by applying the second coat to the insulating layer 3 and drying. The second coat is photographic pigment dispersed in aqueous or toluene solution of the resin or resins (see Example 1).

EXAMPLE 4

The substrate is conducting paper. The first coat is applied to the substrate and dried to yield the insulating layer 3. The first coat is vinyl-ester copolymers with various functional groups, dissolved in toluene. The second coat of Example 3 is applied to the insulating layer 3 and dried to produce the photoconducting layer 4.

EXAMPLE 5

The first coat is applied to the substrate and dried to form the insulating layer. The first coat is polyimide resin dissolved in N-methyl-pyrrolidone and xylene or N,N'-dimethylformamide. The second coat is applied to the insulating layer and dried to yield the photoconducting layer. The second coat is the same as that in Example 3.

The photographic pigment is sensitized ZnO in all examples, e.g., in concentrations of at least 2000 ppm. Suitable sensitizers are well-known photographic-pigment sensitizers and hypersensitizers. The first coat which is applied can be polyamide resin dissolved in chloroform/methanol.

What is claimed is:

1. Procedure for preparing a repeatedly reusable photoconducting charge image carrier, comprising the steps of (A) applying to a substrate (2) a first coat with at least one insulating, nonvolatile ingredient, (B) heating the first coat in order to produce an insulating layer (3) on the substrate (2) said layer having a softening temperature, (C) applying to the insulating layer (3) formed in step B, a second coat containing ZnO as photoconducting material and at least one binder for the ZnO, the photoconducting material being dispersed in a solution of said binder employing a solvent which will not dissolve the insulating layer (3), (D) drying the second coat at a temperature below said softening temperature, and (E) conditioning the resulting charge image carrier, whereby a charge image carrier usable for at least about 4000 cycles obtained.

2. Procedure as in claim 1, wherein the first coat consists of vinyl-ester copolymers with various functional groups dissolved in toluene, and that upon the insulating layer formed by drying this first coat there is applied a second coat having ZnO dispersed in an aqueous solution of said binder, said binder being selected from the group consisting of vinyl-ester resins, acrylates, methacrylates, styrene-acrylates, and combinations thereof.

3. Procedure as in claim 1 wherein polyamides dissolved in chloroform/methanol are used as the first coat.

4. Procedure as in claim 1, wherein the first coat consists of polyvinylidene chloride copolymer dissolved in methyl ethyl ketone.

5. Procedure as in claim 4, wherein the second coat has the ZnO pigment dispersed in an aqueous solution of said binder, said binder being selected from the group consisting of vinyl-ester resins, acrylates, methacrylates, styrene-acrylates, and combinations thereof.

6. Procedure as in claim 4, wherein the second coat has the ZnO pigment dispersed in a toluene solution of said binder, said binder being selected from the group consisting of acrylates, methacrylates, styrene-acrylates, vinyl-ester resins and combinations thereof.

7. Procedure as in claim 1, wherein the first coat consists of methyl methacrylate copolymers with various functional groups, dissolved in toluene, and that said first coat, after being applied to the substrate in step A, is cross-linked in step B by heating to about 200° C., in order to form the insulating layer.

8. Procedure as in claim 7, wherein the second coat applied to said formed insulating layer has the ZnO pigment dispersed in an aqueous solution of said binder, said binder being selected from the group consisting of vinyl-ester resins, acrylates, methacrylates, styrene-acrylates and combinations thereof.

9. Procedure as in claim 7, wherein the second coat to be applied to the insulating layer formed has the ZnO pigment dispersed in a toluene solution of said binder, said binder being selected from the group consisting of vinyl-ester resins, acrylates, methacrylates, styrene-acrylates and combinations thereof.

10. Procedure as in claim 1, wherein polyimide resin dissolved in N-methylpyrrolidone and xylene or N,N'-dimethylformamide is used for the first coat.

11. Procedure as in claim 10, wherein ZnO pigment dispersed in aqueous or toluene solution of the resin or resins is applied to the insulating layer as the second coat.

12. Charge image carrier having an insulating layer (3) adhering to an electrically conducting substrate (2) and above the insulating layer (3), a photoconducting layer (4) containing ZnO as pigment, said carrier being made by the method comprising the steps of (A) applying to a substrate (2) a first coat containing at least one insulating, nonvolatile ingredient, (B) heating the first coat in order to produce an insulating layer (3) on the substrate (2), said layer having a softening temperature;

(C) applying to the insulating layer (3) formed in step B, a second coat containing said ZnO photoconducting material and at least one binder for the ZnO, the photoconducting material being dispersed in a solution of said binder employing a solvent which will not dissolve the insulating layer (3), (D) drying the second coat at a temperature below said softening temperature, and (E) conditioning the resulting charge image carrier whereby a charge image carrier (1) is obtained which can be charged and then discharged by exposure to light at least 4000 times.

* * * * *